United States Patent [19]

Trendel

[11] Patent Number: 4,624,098

[45] Date of Patent: Nov. 25, 1986

[54] CONTAINER RESTRAINT SYSTEM

[75] Inventor: Alois F. Trendel, Temperance, Mich.

[73] Assignee: Owens-Illinois, Inc., Toledo, Ohio

[21] Appl. No.: 790,571

[22] Filed: Oct. 23, 1985

[51] Int. Cl.[4] ..... B67B 3/20; B67B 3/062; B65B 7/28

[52] U.S. Cl. ..... 53/314; 53/331.5; 53/317; 198/480.1

[58] Field of Search ..... 198/480.1, 481.1; 53/317, 308, 306, 331.5, 478

[56] References Cited

U.S. PATENT DOCUMENTS

| | | | |
|---|---|---|---|
| 1,623,825 | 4/1927 | Brown et al. | 198/481.1 |
| 2,423,441 | 7/1947 | Dennie | 198/481.1 X |
| 2,713,960 | 7/1955 | Siegal | 198/481.1 X |
| 2,776,531 | 1/1957 | Filander | 53/317 |
| 3,945,174 | 3/1976 | Franz | 53/317 X |
| 3,957,154 | 5/1976 | Shiba | 198/481.1 X |
| 4,084,686 | 4/1978 | Calhoun | 198/481.1 X |
| 4,308,707 | 1/1982 | Willingham | 53/317 X |

*Primary Examiner*—Horace M. Culver
*Attorney, Agent, or Firm*—John R. Nelson

[57] ABSTRACT

A method and apparatus for restraining containers against rotation when being moved through operation stations of a cap application process. In the embodiment shown a resilient belt is supported on a star wheel so that a section of the belt subtends an arc of each container receiving pocket in the star wheel. In response to the reception of a container in a pocket the belt section conforms to and wraps around the contour of the container. The belt surface contacting the container exerts a frictional force that is greater than the frictional force applied to the container by guide rails as the star wheel moves the container past the guide rails. The container is thus restrained against rotation within the pocket during the cap application process.

7 Claims, 3 Drawing Figures

CONTAINER RESTRAINT SYSTEM

BACKGROUND OF THE INVENTION

1. Field of the Invention.

This invention generally relates to application of closures to containers and, more particularly, to apparatus for restraining a container against rotation during the application of a closure to the container. It is particularly useful for restraining rotation during pre-tightening and final tightening of screw-on closures.

2. Description of the Prior Art.

Innovation in the bottling industry is very dependent on the ready availability of machinery for processing new types of containers and closures. For years, the crown was the dominant closure employed. A different type of closure was then developed, which comprised a cap shell of aluminum which was inserted over the threaded neck end of the container and then secured in place by rolling threads in situ into the walls of the cap shell. Such closures are commonly called roll-on caps.

The roll on cap necessarily required a completely new applicating machine because not only was an axial force necessary to hold the closure in place on the bottle neck and effect a seal between the closure liner and the end of the bottle neck but, concurrently, a rotating movement had to be imparted to the thread forming rollers. There was no practical way that a conventional crown-type applicating machine could be modified to apply the new style roll-on closures and, as a result, the adoption of the new closure proceeded very slowly. It did proceed, however, and now machinery for applying roll-on closures is common.

In recent years, there have been significant developments in plastic technology making the utilization of a threaded plastic closure completely feasible for use in the carbonated beverage field. For example, a threaded closure of the type shown in U.S. Pat. Nos. 3,987,921 and 4,016,996 has been shown to be commercially practicable, and an economically desirable change for the bottler to adopt if applicating machinery was available to assemble the plastic closure to the bottle neck.

Since the plastic closure required a concurrent application of an axial force to the top panel of the closure with a rotation of the closure relative to the bottle neck, it was desirable to utilize existing closure applicating machines for effecting the assembly of aluminum shells to bottle necks to apply the new style plastic closure, and thus minimize the new investment required by the bottler. This was accomplished by a number of modifications of capping heads which may be applied to existing roll-on closure applicating machines.

Some of the roll-on type applicating machines do not incorporate a sufficient rotational movement of the capping head as it approaches its lowermost position relative to the bottle to effect the complete threading of a closure onto the threaded bottle neck. Therefore, pre-tightening mechanisms were developed, which partially apply a threaded closure on the threaded neck of a bottle prior to a closure being engaged by the applicating head.

In addition, problems were encountered in keeping the container from rotating during the final closure tightening process when sufficient torque is applied to seal the closure on the neck, yet allowing the closure to be manually removed by the ultimate consumer.

Restraint systems to control container rotation have been added on to application machinery to press against containers from the outside during the final tightening of the closure. However, these systems have not been satisfactory since the containers are already turning when they reach the system and it has to apply braking torque. It takes on undesirable amount of friction and pressure to stop a container from rotating after it is already turning, which may damage container labels or the containers themselves and/or interfere with the application of the correct amount of torque to seal the closure on the neck. Similar problems are met when the turntable surfaces are covered with friction material to stop container rotation.

SUMMARY OF THE INVENTION

The method and apparatus for restraining containers against rotation when being moved through operation stations of a cap application process, in accordance with the teachings of this invention, includes a rotatable star wheel having a plurality of outwardly opening pockets formed therein for receiving and moving containers from a container receiving station to a container discharge station. Stationary guide rails are disposed along the periphery of the star wheel to retain the containers in the pockets. Normally, movement of containers by the star wheel past the guide rails causes container rotation in the pockets, which interferes with the most efficient functioning of pre-tightening and final tightening of threaded closures on the threaded necks of containers.

To prevent such rotation in the pockets, means are mounted on the star wheel adjacent each of the pockets for frictionally engaging containers in the pocket with a force in excess of the frictional force applied to the containers by the guide rails.

In the embodiment shown, a resilient belt is supported on the star wheel so that a sector of the belt is disposed across each of the pockets. Thus, when a container is received in the pocket the belt is urged away from the guide rails and wraps around the contour of the container. In a preferred embodiment the belt is formed from urethane and the guide rail container contact surfaces are formed from a smooth plastic to insure an adequate difference in coefficients of friction to prevent rotation of the container.

The belt thus comprises a resilient means adapted to be biased away from a normal at-rest position within the confines of each pocket in response to reception of a container in the pocket. The biasing or urging of the resilient means increases the frictional force exerted by the resilient means.

In the cap application machinery disclosed herein, the container restraint system is used on both an in-feed and a capping star wheel to prevent rotation of containers during the placing of the closure on the neck, pre-tightening of the closure into and final tightening of the closure into a sealing position on the neck.

The object of this invention, therefore, is to provide an improved method and apparatus for restraining containers against rotation during a cap application process.

Other objects, advantages and features of this invention will become more apparent during the course of the following description when read in conjunction with the accompanying drawings.

BRIEF DESCRIPTION OF THE DRAWINGS

In the drawings, where like numerals are employed to designate like parts throughout.

DESCRIPTION OF THE PREFERRED EMBODIMENT

Figure 1:
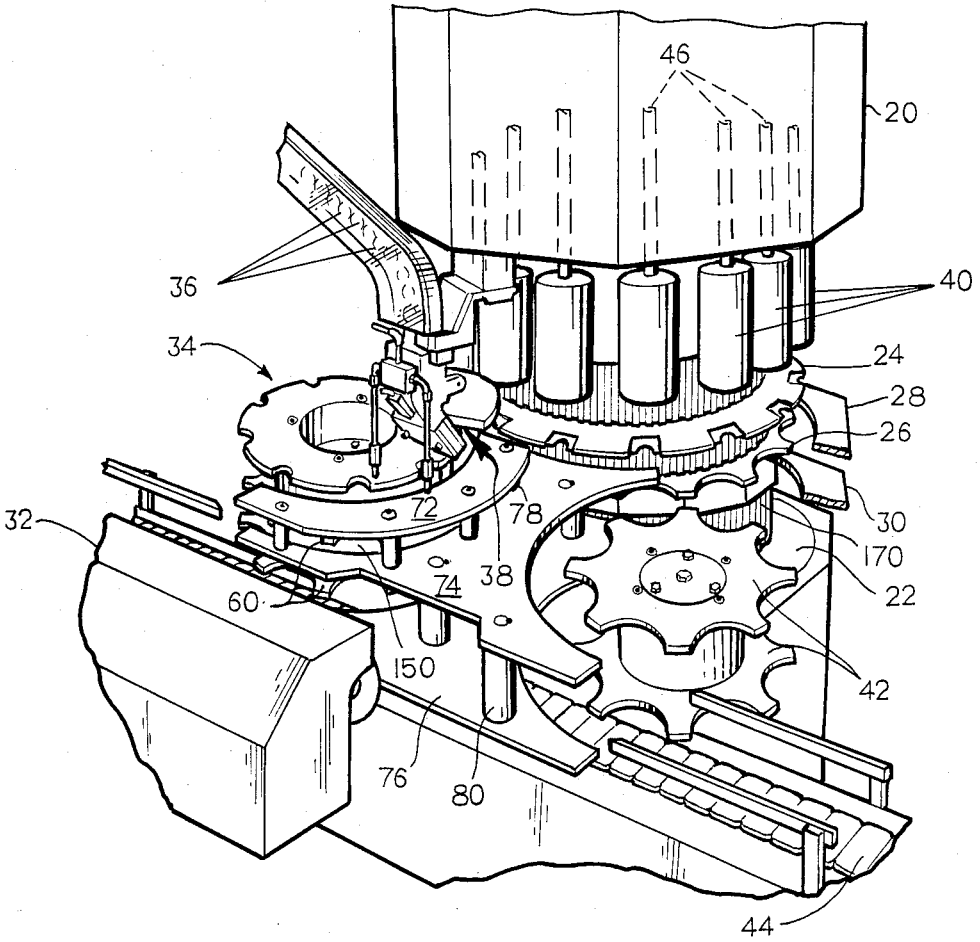
FIG. 1 is a schematic perspective view of a complete cap applicating machine incorporating a container restraint system of this invention.

Referring now to FIG. 1 there is illustrated a capping machine of the type manufactured and sold by Aluminum Company of America for the application of roll-on closures to the threaded necks of beverage bottles. This machine and conversion apparatus for providing capping heads to effect the application of an internally screw threaded plastic closure to the threaded neck of a bottle is discussed and disclosed in U.S. Pat. No. 4,295,320 and other U.S. patents. Therefore, the mechanism of the entire capping machine will not be described in detail.

A rotating turret 20 moves with a rotating capper bottle table 22. Capper star wheels 24 and 26 located above table 22 also rotate with table 22 and provide lateral support to the side wall and neck portions of the bottles as they are moved in a circular path by the rotary bottle table 22. Guide rails 28 and 30 hold the bottles in the outwardly opening capper star wheel pockets.

Bottles, which may be filled with carbonated beverage or any other liquid product, are supplied to the rotary table 22 by a conventional in-feed worm 32 or other container supplying mean and in in-feed or transfer star wheel 34. Immediately before entering the rotary table 22, an internally threaded plastic cap 36 is loosely deposited on the neck of each bottle by a conventional cap feeding mechanism 38. The caps 36 are successively engaged by the rotating applicating heads 40 and applied to the threaded neck of the bottles as the bottles are moved around beneath the heads 40 by the rotary table 22. The capped bottles are removed from the rotary bottle table 22 by a conventional out-feed star wheel 42 and deposited on a moving conveyor 44 which conveys them to a case packer (not shown).

The rotating turret 20 of the capping machine provides a mounting for a plurality of vertically disposed hollow shafts 46 on the bottom end of which are the capping heads 40. The shafts 46 are continuously rotated and, as the shafts 46 are moved in their rotary path by the turret 20, they are successively vertically displaced toward the rotary bottle table 22 to bring the capping heads 40 respectively into firm engagement with the top portion or panel of a cap 36 which is respectively positioned on the neck of a bottle beneath each capping head. Capping heads 40 exert a combined axial thrust and rotational force upon each cap 36 to effect the threading of the cap 36 onto the threaded neck of a bottle, following which the capping heads are raised relative to the bottle and the capped bottle is thus freed for discharge into the removal or out-feed star wheel 42.

Figure 2:
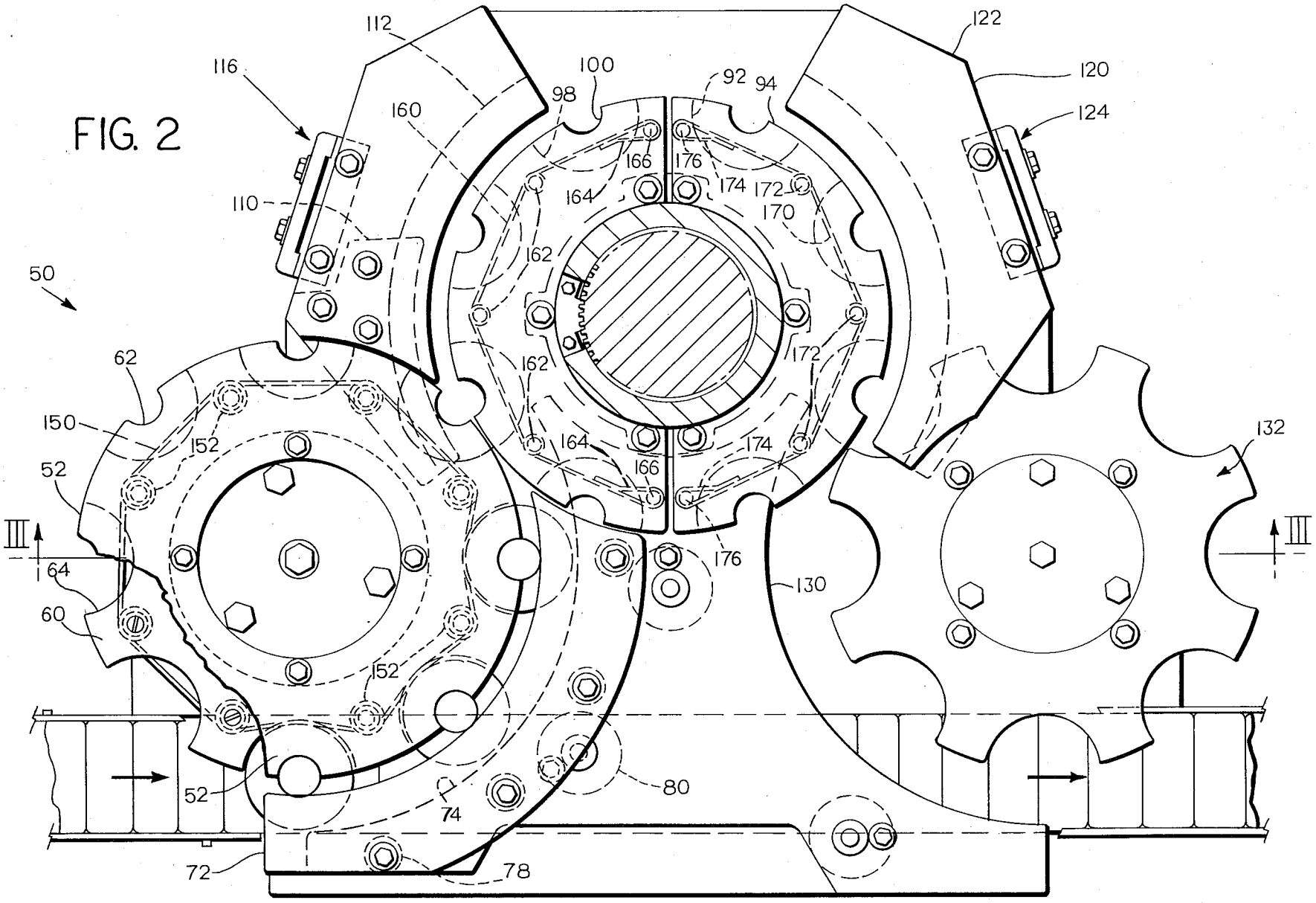
FIG. 2 is a plan view of in-feed, capping and discharge star wheels that may be used in the machine illustrated in FIG. 1.
Figure 3:
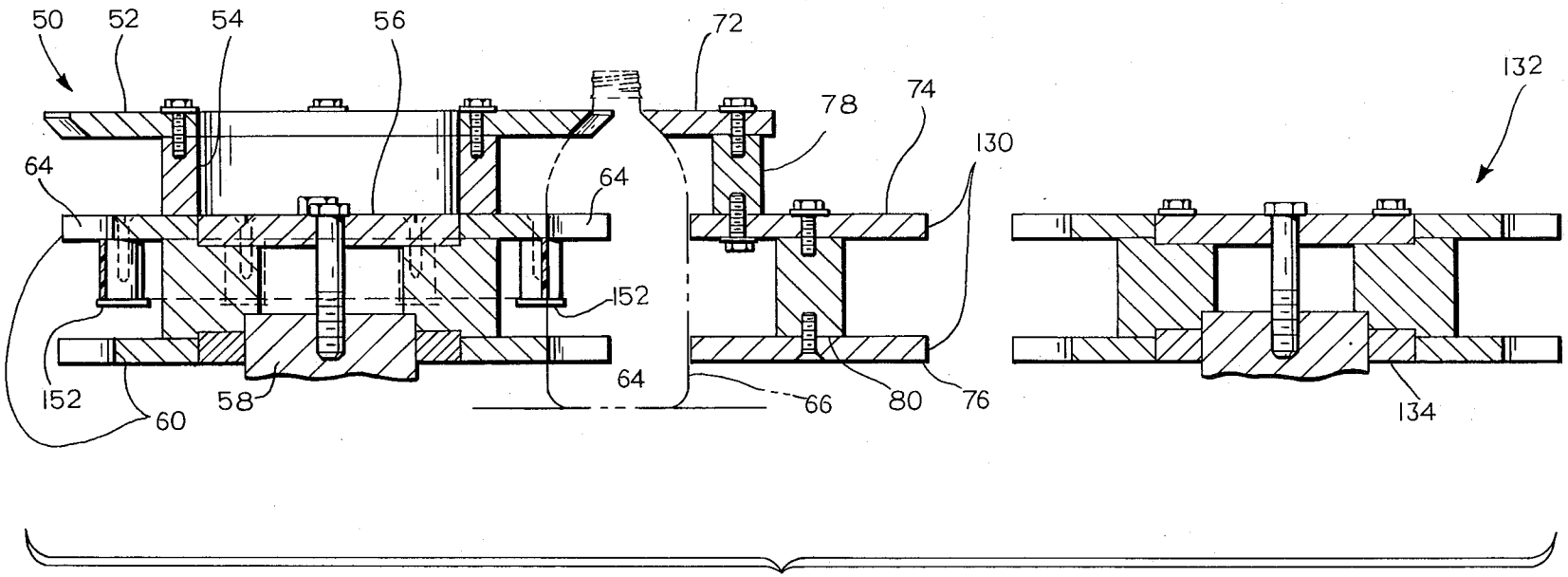
FIG. 3 is a cross-sectional view taken along lines III—III of the apparatus illustrated in FIG. 2.

Referring now to FIGS. 2 and 3 there is illustrated in detail an embodiment of the teachings of this invention which is applicable to the type of capping machine shown and described generally in FIG. 1.

An in-feed star wheel assembly designated generally at 50 includes an in-feed star wheel neck plate 52 and an in-feed neck hub 54. A hub cap is shown at 56, and with full hub 58 supports in-feed star neck plate 52 and bottle body plates 60 in a desired spaced and aligned position so that neck pockets 62 and body pockets 64 respectively formed in plates 52 and 60 may receive bottles 66 as shown in FIG. 3 from the worm in-feed 32. A timing ring 68 coordinates the movement of in-feed star assembly 50 with the movement of the capper star wheel assembly 90 and the discharge star wheel assembly 132.

An in-feed neck guide 72 and bottle body guides 74 and 76 are in spaced and aligned positions by spacer support assemblies 78 and 80 to guide bottles 66 into pockets 62 and 64 and retain the bottles therein.

A capper star wheel assembly is designated generally at 90 and includes a bottom capper split star wheel 92 and a top capper split star wheel 94. A split hub assembly 96 supports the bottom and top split star wheels in spaced and aligned positions so that body pockets 98 and neck pockets 100 receive bottles 66. A timing ring means 102 coordinates the movement of the capper star wheel assembly 90 with the in-feed and discharge star wheel assemblies 50 and 132. The capper star wheel assembly is formed in the split segment arrangement as shown so that it may be attached to and removed from the cap applicating machine without a major disassembly of the entire machine.

Bottom capper in-feed guides 10 and 112 cooperate with top capper in-feed guide 114 to enable transfer of bottles 66 from the in-feed star wheel assembly 50 to the capper star wheel assembly 90. A bracket assembly 116 supports guides 110, 112, and 114 in the desired spaced and aligned relationship. A bottom bottle body guide 120 and a top neck guide 122 supported in spaced and aligned relationship by bracket assembly 124 cooperate to retain the bottles 66 in pockets 98 and 100, respectively, as the capping operation is being finished.

Upper and lower bottle body discharge guide surfaces 130 transfer the bottles 66 from the capper star wheel assembly 90 to a conventional discharge star wheel assembly 132, which then deposits the bottles 66 on the bottle conveyor 44. A timing ring 134 coordinates the movement of the discharge star wheel assembly 132 with star wheel assemblies 50 and 90.

As an aid in the capping process, pre-tightening mechanisms as disclosed and described in U.S. Pat. No. 4,308,707 have been added to the capping machinery. Some roll-on type applicating machines did not incorporate a sufficient rotational movement of the capping head as it approaches its lowermost position relative to the bottle to effect the complete threading of a closure onto the threaded bottle neck.

Such a pre-tightening mechanism will partially apply a threaded closure on the threaded neck of a bottle prior to the closure being engaged by the applicating head. Pre-tightening on the order of one half to a full turn of the closure threads relative to the bottle threads may be required and, during the initial threading action, it is very desirable that a constant downward force be maintained on the panel portion of the closure. At the same time, the panel portion of the closure must be maintained in a horizontal plane. In this manner, cocking or cross threading of the closure on the bottle threads will be avoided.

The pre-tightening mechanism of U.S. Pat. No. 4,308,707 includes a frictional rail which is disposed along the path of movement of a closure loosely positioned on the neck of a bottle as the bottle and closure are moved into an applicating machine. The frictional rail is located adjacent the in-feed star wheel assembly 50 and the cap feeding mechanism 38, and engages the side wall of the closure and effects a relative turning of the closure with respect to the bottle so as to initiate the threading of the closure onto the threads on the bottle neck. Concurrently, the top panel of the closure is engaged by a hold-down plate which, through a spring biased linkage, is floatingly supported to engage the top panel of the closure and maintain it in a horizontal plane. At the same time the linkage and hold-down plate maintains a substantially constant axially downward force on the closure to assist in initiating the preliminary threading operation.

Mechanical details of the pre-tightening mechanism have been omitted from the drawings herein for the purposes of making the features of the present invention more readily visible, however, those details are fully disclosed in the above-referenced U.S. Pat. No. 4,308,707.

In the past the problems encountered with container rotation during the capping process were addressed by add-on mechanisms that were, for example, attached to the machine at brackets 116, 124 in place of or in addition to the guides, or by coated turret tables. Since the bottles are rotating before they reach such devices, the devices must apply braking torque. It takes an undesirable amount of friction and pressure to stop the rotation, which may lead to label or container damage or otherwise interfere with the application of a measured amount of torque in the final tightening of the closure to seal the contents.

In the present invention these problems have been solved by providing a container restraint system in which the containers are engaged before any significant rotation starts. This is accomplished by supporting a belt 150 on the in-feed star wheel assembly 50 from a plurality of belt posts 152 depending from the upper bottle body plate 60.

The belt 150 is positioned by the posts 152 so that the outer surface subtends an arc of each of the pairs of aligned bottle body pockets 64 in plates 60. The belt 150 is made of flexible and resilient material such as rubber or urethane. In the embodiment shown, flat belting having a width of 1.25 inches and a thickness of 0.09 inches, and made from urethane provides the required characteristics.

When a bottle 66 is received from the in-feed worm 32 at the input of the guides 72, 74, 76, the belt 150 is stretched inwardly to wrap around and conform to the contour of the bottle body. The surface friction characteristics of the belt are designed to engage and hold the surface of the bottle or label thereon to prevent rotation of the bottle, even though friction from the guides 72, 74, 76 is attempting to rotate the bottle as the star wheel assembly 50 moves the bottle toward capping star wheel assembly 90. The frictional engagement of the bottle by the belt is a combination of the friction characteristics of the surface of the belt and the area of contact between the belt and the body. This frictional force is greater than the frictional force exerted by the guide surfaces in contact with the bottle. The guide surfaces are preferably formed of a smooth plastic such as nylon to reduce the friction force exerted by the guides below that exerted by the belt.

The rotational restraint at the in feed star wheel assembly 50 is not only advantageous because of the engagement of the bottles before they start rotating, but also because it insures a stable stationary bottle neck for the initial application of the plastic closures 36 thereto. Moreover, the stability of the bottle neck enhances the performance of the pre-tightening mechanisms discussed hereinbefore. Further, the pre-tightening mechanism can reliably repeat an operation of one-half or full or other predetermined initial turn of the closure relative to the bottle, if the bottle itself is not rotating, especially since the bottles rotation speeds may vary because of varying operating conditions.

Referring now to the capper star wheel assembly 90, it can be seen that the same principles have been applied. In this instance, the assembly 90 is shown as a split star wheel. Therefore the belt engagement system is split between the two halves. A belt segment 160 is supported by belt posts 162 between bottle body star wheel plates 92 so that the outer surface of the belt segment subtends an arc of each of the pairs of bottle body pockets 98. In this embodiment the segment 160 is retained in place by loops 164 formed at the ends of belt 160 and mounted on the end posts 166 in the series of posts 162.

A belt segment 170 serves the other half of the split star wheel assembly. Again, the segment is similarly supported by belt posts 172 between plates 92 so that the outer surface of the belt segment subtends an arc of each of the bottle body pockets 98 on this half of the assembly 90. Loops 174 at the ends of segment 170 are mounted on end posts 176 in the series of posts 172.

Two sets of guide rail means are provided at 110, 112 and 114 and at 120, 122 for retaining the containers within pockets 98, 100. Such guide means are not needed between the two sets in this embodiment because capping heads 40 are engaged with the closure/-container combination at this point, and hold the containers in position without need for guide rails.

In operation, the belt segments 160, 170 function in the same manner as belt 150 on in-feed star wheel assembly 50. The guides 110, 112, 114 pick up the bottles 66 from assembly 50 and retain the bottles in pockets 98, 100 in capper star wheel assembly 90. The belt segments 160, 170 are stretched inwardly to conform to the contour of the bottle body. Again, the frictional force exerted by segments 160, 170 is greater than the frictional force exerted by the guide surfaces in contact with the bottle. The segments may be made of rubber or urethane and the guides of nylon.

Thus, the bottles are restrained against rotation, thereby enabling capping heads 40 to properly limit maximum torque applied to the plastic closures, avoiding tearing and/or cracking from excessive applicating force yet insuring enough torque to seat and seal the closure on the bottle neck. Moreover, the maximum applicating torque may be maintained substantially constant for effective sealing yet enabling manual removal by the ultimate consumer.

It is to be understood that the form of the invention herewith shown and described is to be taken as an illustrative embodiment only, and that various changes in the shape, size and arrangement of the parts or in the steps of the method may be made without departing from the spirit and scope of the invention.

I claim:

1. A capping machine for applying threaded caps to threaded bottle necks, comprising:

a. a rotatable turret carrying a plurality of capping heads, b. rotatable capping star wheel means having a plurality of pockets formed therein for receiving and moving containers having circular cross-sections around, beneath and in synchronism with said plurality of capping heads, c. capper guide means spaced from said capping star wheel means for engaging circular cross-sections of and retaining containers in said capper pockets, and d. means supported on said capping star wheel means for yieldingly urging containers in said capper pockets against said guide means, said urging means having a greater frictional engagement with a container than said guide means thereby restraining containers against rotation in said pockets during movement of said capping star wheel means.

2. A capping machine as defined in claim 1 in which said yieldingly urging means comprises resilient belt means supported to subtend an arc of each of said capper bottle receiving pockets of said capping star wheel means.

3. A capping machine as defined in claim 2 in which said belt mean is formed from urethane.

4. A capping machine as defined in claim 1 in which the bottle contact surfaces of said guide means are formed from a smooth plastic to reduce the frictional engagement of the guide means.

5. A capping machine as defined in claim 1 which further includes a. an in-feed star wheel means having a plurality of pockets formed therein for transferring containers from a container supplying means to said capping star wheel means, b. in-feed guide means spaced from said in-feed star wheel means for retaining containers in said in-feed pockets, and c. means carried on said in-feed star wheel means for restraining containers in said in-feed pockets against rotation during movement of said in-feed star wheel means.

6. A capping machine as defined in claim 5 in which said in-feed container rotation restraining means comprises means for yieldingly urging containers in said in-feed pockets against said in-feed guide means, said urging means having a greater frictional engagement than said in-feed guide means.

7. A capping means as defined in claim 6 in which said in-feed rotation restraining means comprises resilient belt means supported to subtend an arc of each of said in-feed bottle receiving pockets of said in-feed star wheel means.

* * * * *